US006665950B1

(12) United States Patent
Riepe et al.

(10) Patent No.: US 6,665,950 B1
(45) Date of Patent: Dec. 23, 2003

(54) GAS-HEATED INFRARED RADIATOR FOR AN INFRARED DRYING UNIT

(75) Inventors: Uwe Riepe, Herten (DE); Richard Aust, Mönchangladbach (DE); Peter Arlinghaus, Düsseldorf (DE); Juan Paniagua, Hückelhoven (DE); Frank Schicht, Neuss (DE)

(73) Assignee: Krieger GmbH & Co., KG, Monchengladbach (DE)

( * ) Notice: Subject to any disclaimer, the term of this patent is extended or adjusted under 35 U.S.C. 154(b) by 0 days.

(21) Appl. No.: 10/019,002

(22) PCT Filed: Jun. 14, 2000

(86) PCT No.: PCT/EP00/05447

§ 371 (c)(1),
(2), (4) Date: Apr. 24, 2002

(87) PCT Pub. No.: WO00/79045

PCT Pub. Date: Dec. 28, 2000

(30) Foreign Application Priority Data

Jun. 19, 1999 (DE) ..... 199 28 096

(51) Int. Cl.[7] ..... F26B 3/34

(52) U.S. Cl. ..... 34/266; 34/266; 34/267; 34/68; 285/231; 431/354; 431/1

(58) Field of Search ..... 34/266, 267, 68, 34/60; 431/1, 326, 328, 344, 354; 285/231

(56) References Cited

U.S. PATENT DOCUMENTS 3,499,232 A 3/1970 Zimmermann
4,333,003 A * 6/1982 Rivera ..... 219/377
4,691,942 A * 9/1987 Ford ..... 285/84
4,843,731 A * 7/1989 Vits ..... 34/10
4,861,261 A * 8/1989 Krieger ..... 431/1
5,135,390 A * 8/1992 Rodriguez ..... 431/344
RE34,541 E * 2/1994 Kreiger ..... 431/1
5,816,235 A * 10/1998 Kim et al. ..... 126/39 H

FOREIGN PATENT DOCUMENTS

EP 0 128 202 B1 11/1992

* cited by examiner

*Primary Examiner*—Ira S. Lazarus
*Assistant Examiner*—Camtu Nguyen
(74) *Attorney, Agent, or Firm*—Herbert Dubno; Andrew Wilford

(57) ABSTRACT

Known gas-heated infrared radiators for infrared drying units have a radiator housing (1) that is subdivided by a gas-permeable burner plate (5) in a distribution chamber (6) for the gas-air mixture and a combustion chamber (7), the front side of which emits the radiation. The radiator is held by mixing tube (9) that is affixed to the rear side. A gas-air mixture is supplied to the distribution chamber (6) via said mixing tube (9). The mixing tube (9) has a gas nozzle (11) with a gas inlet (12) and an air inlet (17) on the end opposite the radiator housing (1). The mixing tube is affixed to a holding frame of the drying unit. In order to disassemble the infrared radiator from the infrared drying unit and to mount said radiator on said unit as rapidly as possible, the rear side of the radiator housing (1) is connected to the holding frame by releasable fixing means (20, 33–36) that can be released manually from the front side.

12 Claims, 4 Drawing Sheets

GAS-HEATED INFRARED RADIATOR FOR AN INFRARED DRYING UNIT

CROSS REFERENCE TO RELATED APPLICATIONS

This application is the US national phase of PCT application PCT/EP00/05447 filed Jun. 14, 2000 with a claim to the priority of German patent application 19928096.7 itself filed Jun. 19 1999.

FIELD OF THE INVENTION

The invention relates to an infrared radiator for an infrared drying unit with a radiator housing that is subdivided internally by a gas-pervious burner plate into a distributing compartment for the gas/air mixture and into a combustion compartment. A large portion of the energy contained in the combustion gases is convectively transmitted in the combustion compartment to a solid body that gives this energy up as infrared radiation at its front side. The radiator has a back housing wall mounted on a mixing tube through which an gas/air mixture is supplied to the distributing compartment, the mixing tube having on its end remote from the radiator housing a gas nozzle with a gas feed, being connected to an air feed, and being fixed on a frame of the drying unit.

BACKGROUND OF THE INVENTION

Such infrared radiators are as is known installed in dryer systems that serve for drying web-like materials, for example paper or cardboard webs. Depending on the width of the web to be dried and the desired heat capacity, the necessary number of radiators are assembled in one or more rows to a drying unit, the individual radiators being mounted immediately adjacent one another. Such an infrared radiator is described in EP 0,128,202.

Gas-heated infrared radiators are subject to wear in use so that it is necessary to replace them after a service life of about two to four years. In addition they must be serviced as a rule once or twice a year in order to check whether the gas nozzle in the mixing tube or the radiator itself is dirty. Switching and servicing the known radiators is very time intensive since several steps must be carried out to remove the radiator housing and clean the nozzles, carried out when the dryer is cooled off and is thus not in use. This creates down times for the equipment in which the drying unit is integrated, for example a coating system for paper or cardboard webs.

OBJECTS OF THE INVENTION

It is therefore an object of the invention to improve on this type of infrared radiator and/or mount therefor so that it can be removed as quickly as possible from and reinstalled back into an infrared drying unit.

SUMMARY OF THE INVENTION

This object is attained according to the invention in that the radiator housing is connected on its rear side with the frame via releasable fastening means which are manually releasable from the front side.

The radiator can thus be rapidly removed and again reinstalled, working from the easily accessible front side. Servicing parts of the radiator can be done outside the equipment under no particular time constraints.

In one embodiment, the radiator housing is bolted on the mixing tube via screws that can be tightened or loosened from the radiating front side of the radiator. Preferably the screws are so constructed and screwed in so far that their heads are in the cooler distributing compartment for the gas/air mixture behind the burner plate and not in the hot combustion compartment in front of the burner plate. The burner plate thus has corresponding bores through which the screw heads can be reached with a tool. If a metal mesh overlies the radiating surface, it is either only clipped in place so it is easily removed or it also has aligned bores.

The radiator is particularly advantageous and easy to remove when equipped with a speed coupling that is releasable by pushing or pulling on the front side, that is by a force parallel to the axis of the mixing tube. The speed coupling can be made of a standard coupling mechanism and includes as coupling parts a sleeve-shaped holding part and an insert part that can be coupled with each other, the coupling force being exerted by spring elements that free the insert part when pushed or pulled.

The speed coupling is between the housing back wall and the mixing tube, between the gas-supply line and the gas nozzle, or inside the mixing tube. The gas nozzle is preferably fixed in the mixing tube. In the particularly advantageous embodiment, the gas nozzle is removable from the drying unit with the mixing tube and the radiator housing fixed thereto and can thus be serviced outside the equipment. When the gas nozzle is bolted into one coupling part of the speed coupling, it is accessible after opening of the speed coupling and can simply be screwed out.

A preferred and even particularly advantageous embodiments of an infrared radiator is secured in a solid and gas-tight manner on the frame and that is removable by pressure on the front side of the radiator housing.

The infrared radiator has a socket part, an insert part at least partially slidable against the force of a spring into the socket part, and a latching mechanism with a latch element and a complementary socket element. The latching element is fixed on one of the coupling parts, moves on fitting of the one coupling part into the socket element on the other coupling part, and is mounted on a pivotal mechanism that is actuated on movement of the insert part of the speed coupling against the socket part and alternately moves the latch element into a latch position holding the coupling parts together or an unlatched position in which the coupling parts can be separated from each other.

BRIEF DESCRIPTION OF THE DRAWING

The drawing shows preferred embodiments of the invention. Therein.

SPECIFIC DESCRIPTION

Figure 1:
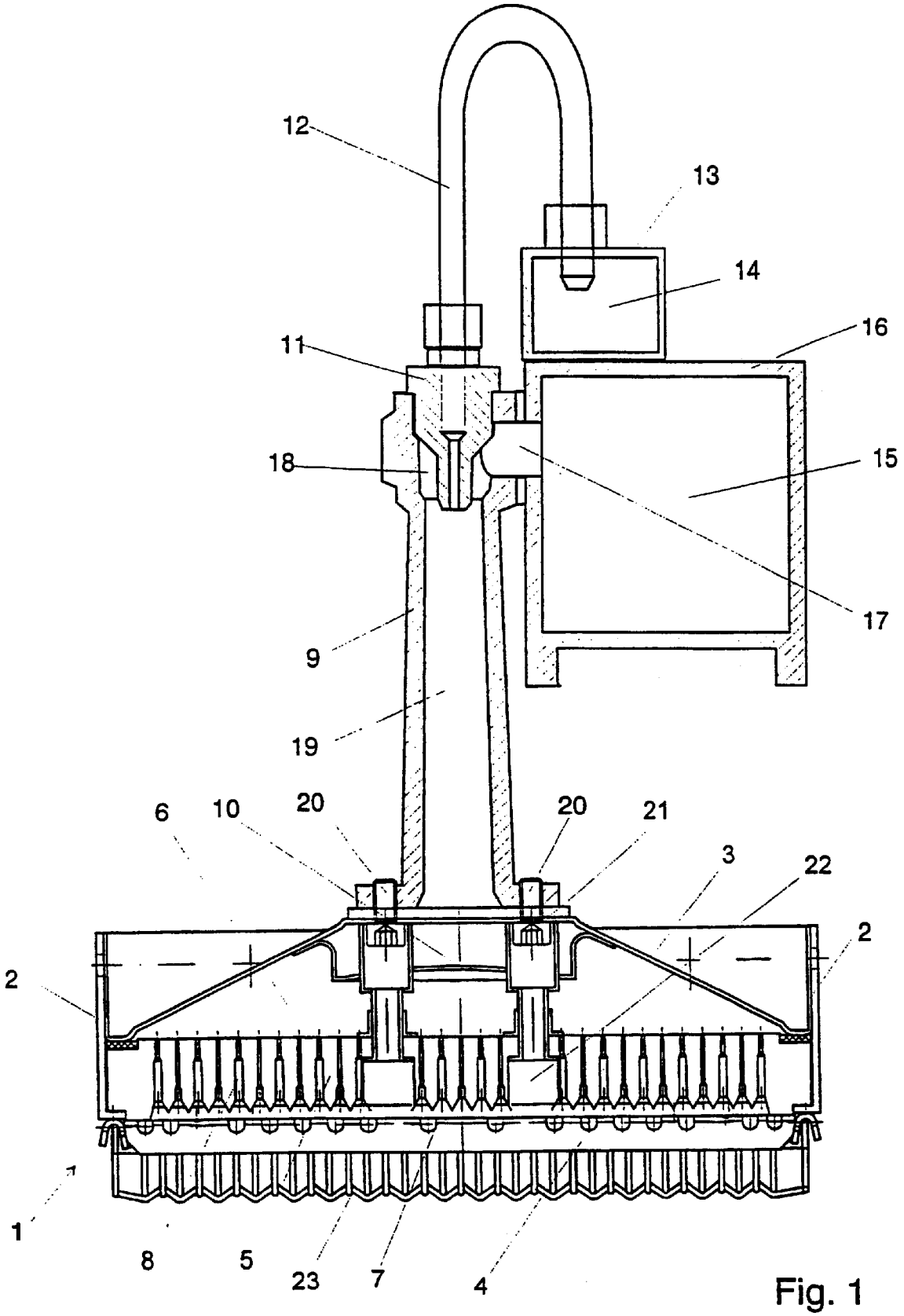
FIG. 1 shows an embodiment of an infrared radiator with a mixing tube bolted to the radiator housing.

The infrared radiator includes a radiator housing 1 that is formed by perpendicular side walls 2 and a back wall 3.

The interior of the radiator housing 1 is subdivided by a gas-pervious burner plate 5 whose back face forms with the back wall 3 a distributing compartment for the supplied gas/air mixture. Downstream in the flow direction from the burner plate 5 is a combustion compartment 7 in which the gas/air mixture flowing through holes 8 in the burner plate 5 is burnt. A large portion of the combustion energy is transmitted convectively to solid bodies that give it up as infrared radiation on the front side of the radiator.

Figure 2:
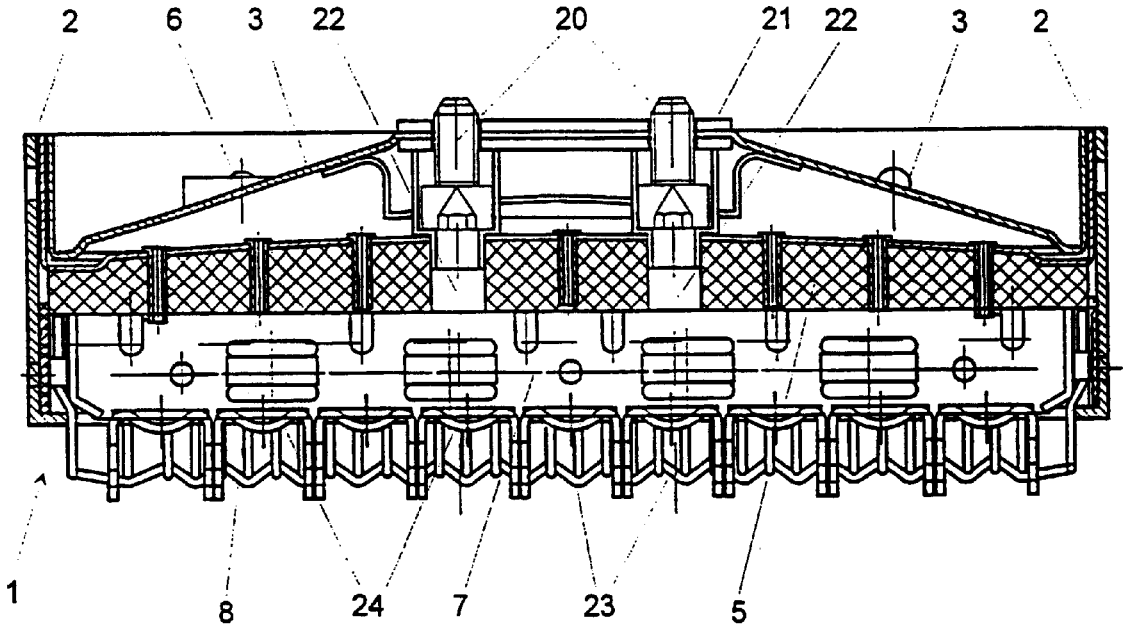
FIG. 2 shows the radiator housing of another embodiment of a radiator when unbolted.
Figure 3:
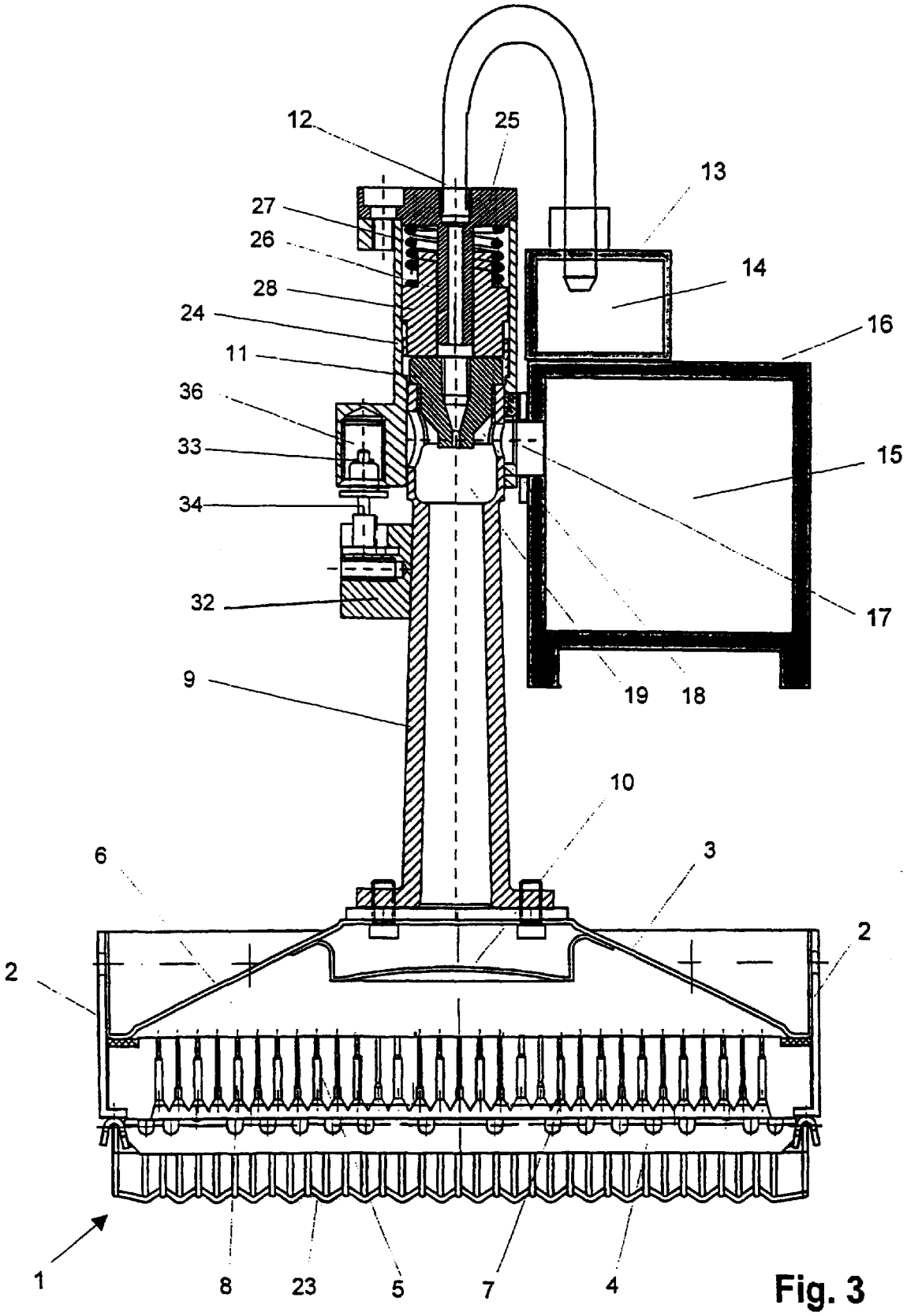
FIG. 3 shows a section through an infrared radiator with a speed coupling.
Figure 4:
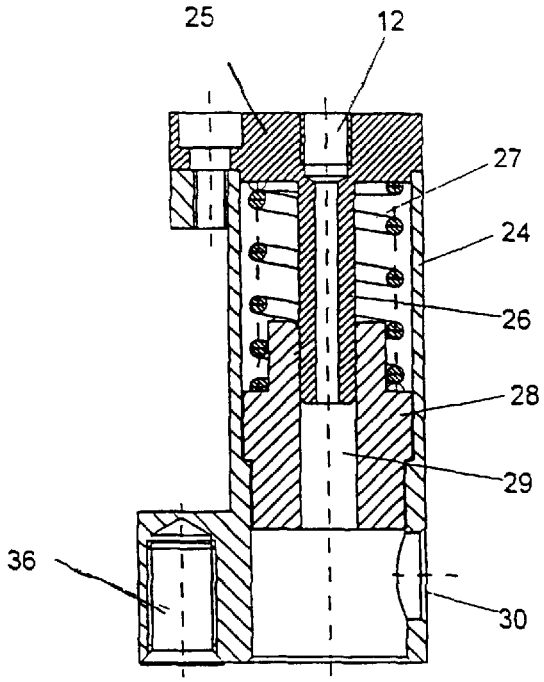
FIG. 4 is a section through the end of a gas-feed tube with the socket part of the speed coupling.
Figure 5:
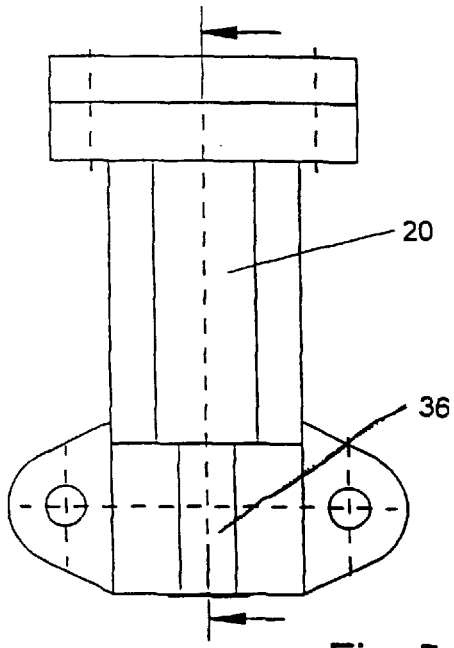
FIG. 5 is a side view of the elements of FIG. 4.
Figure 6:
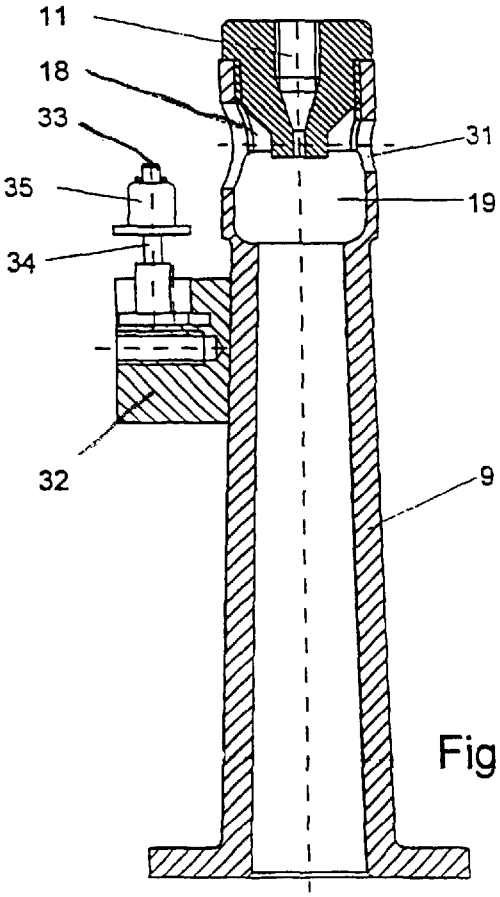
FIG. 6 is a section through the mixing tube with the insert part of the speed coupling.
Figure 7:
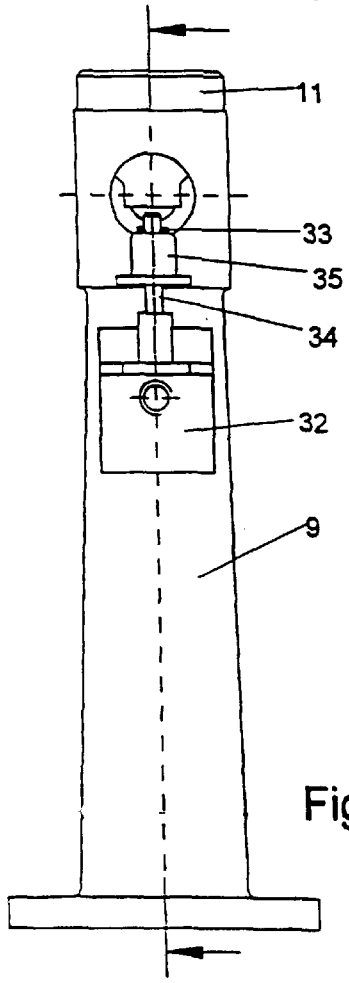
FIG. 7 is a side view of the elements of FIG. 6.

In the embodiments according to FIGS. 1 and 3 the solid bodies are a ceramic burner plate 5 and a mesh 23 with a frame 4. In the embodiment according to FIG. 2 the solid bodies are several radiator bodies 24 and a mesh 23 that holds the radiating bodies 24. In all embodiments the mesh 23 forms the front side of the radiator.

The radiator housing 1 is carried by a mixing tube 9 fixed to its back side and opening into the distributing compartment 6. In order to distribute the gas/air mixture uniformly over the back face of the burner plate 5, a baffle 10 is provided in the distributing compartment 6 against which the mixture flowing out of the mixing tube 9 impinges.

A gas nozzle 1 connected to a gas-supply line 12 is screwed into the upper end of the mixing tube 9 turned away from the radiator housing 1. The gas-supply line 12 is connected with a manifold 13 from which a plurality of radiators are supplied with gas 14. Air 15 is supplied via a hollow transverse beam 16 on which the mixing tube 9 is mounted. The connecting conduit 17 for the air supply opens into an upper part of the mixing tube 9 in a downwardly open air compartment 18 surrounding the outlet end of the gas nozzle 11, so that a mixing compartment 19 of the mixing tube 9 is filled from the top with a gas/air mixture.

Several radiators are arranged directly over the width of the web to be dried and form a drying unit. If the desired heat capacity requires it, several rows can be arranged one behind the other in the web-travel direction. The radiators are fixed on a holder frame of the drying unit. In the embodiments according to FIGS. 1 and 3 the hollow transverse beam 16, on which the mixing tube 9 is mounted with the housing 1, serves to hold the radiator. The hollow transverse beam 16 is thus part of the frame of the drying unit.

It is significant for the invention that the radiator housing 1 be secured with the frame (in FIGS. 1 and with the hollow transverse beam 16) by releasable fastening means that is manually releasable from the radiating front face.

In the embodiment according to FIGS. 1 and 2, the radiator housing is releasably secured by its back wall 3 at the end of the mixing tube 9 via screws 20. To this end the back wall 3 has an annular flange 21 that is solidly bolted to a flange-shaped widened end of the mixing tube 9. The screws 20 are so short that their Allen heads are in the mounted position of FIG. 1 inside the distributor compartment 3, that is behind the burner plate 5. When the radiator is in use they are thus in a completely flame-free portion of the radiator and are not excessively heated. Since the screws 20 have to be loosened from the front side of the radiator, the burner plate 5 and the radiator body 4 have aligned bores 22 through which a tool can be passed to loosen and tighten the screws 20.

According to further embodiments of the invention the releasable fastening means is a speed coupling that is released by pressure or tension from the front side, that is by a force aligned axially with the mixing tube 9. The speed coupling is based on a standard coupling mechanism and is comprised as is known of a sleeve-like socket and an insert that can be clamped together when axially fitted together and that can also be released from each other by an axial pull or push. The coupling force is applied by springs that are released by pushing or pulling on the insert. Preferably the coupling parts are tubular so that the gas, the air, and/or the gas/air mixture can flow through the speed coupling.

It is important for the invention that the force for connecting or releasing be exerted exclusively from the front side of the radiator housing without having to move the radiator housing 1 to the side.

According to an embodiment, the speed coupling is mounted between the housing back wall and the mixing tube. The mixing tube thus stays when released with the frame; only the radiator housing is released.

According to the preferred embodiment, the speed coupling is mounted on the upper end of the mixing tube between the gas-supply line and the gas nozzle. The releasable part of the speed coupling holds the gas nozzle. Thus the radiator with the mixing tube and the gas nozzle mounted on it are released. The gas-supply is fixed to the frame. The elements for feeding in gas are made sufficiently robust that they serve in use as holder for the radiator with the mixing tube. A preferred embodiment of such a infrared radiator is shown in FIGS. 3 through 7 and is described in detail below:

The speed coupling includes two coupling parts: a socket with the gas supply (FIGS. 4 and 5) that is mounted on the hollow transverse beam 16 and an insert (FIGS. 6 and 7) that is formed by the upper end of the mixing tube 9.

The socket part has a sleeve-shaped housing 24 that is bolted to the hollow transverse beam 16 as part of the frame. The housing 24 has in its lower portion a somewhat restricted inside diameter so as to form an annular restriction at the transition between the lower part and an upper part. The housing 24 is closed at the gas-supply side with a plug 26 that has a central passage to which is connected the gas-supply line 12. Inside the housing 24 the passage holds a central tube 26 over which is fitted a compression spring 27. The spring 27 presses against a seal member 28 that fits the inside diameter of the housing 24 and has a central throughgoing passage 29 in which the end of the tube 26 fits gas-tight. The seal member 28 slides on the tube 26 axially, its upper end position being determined by the plug 25 and its lower end position by the restriction inside the housing 24. The gas can thus travel from the supply line 12 through the tube 26 and the seal member 28 into the lower open part of the housing 24 where there is a lateral opening 30 for the air supply 17.

The insert part of the speed coupling is formed by the upper end of the mixing tube 9 that is closed by the gas nozzle 11. The outside diameter of the end of the mixing tube 9 with the gas nozzle 11 is dimensioned for insertion into the inside diameter of the lower end of the housing 24. On insertion of the mixing tube 9 with the gas nozzle 11 into the housing 24 the upper end of the gas nozzle 11 engages sealingly on the seal member 28 which covers the nozzle opening with the throughgoing passage 29 so that gas can flow out of the gas-supply line 12. The insert part of the speed coupling (the end of the mixing tube 9 with the gas nozzle 11) is thus slid against the force of the spring 27 into the housing so that, as shown in FIG. 3, the gas nozzle 11 is wholly and the mixing compartment 19 partially in the housing 24. In this position the lateral opening 31 is aligned with the opening 30 in the housing, to which the air supply 17 is connected. Air can thus flow through both openings 30 and 31 into the air compartment 18.

In order that the insert part of the speed coupling is connected both without leakage and solidly on the mixing tube, while still being removable from the socket part formed by the housing 24, both parts carry respective elements of a latching mechanism that is released by pressure on the front side of the radiator housing 1. The latching mechanism includes a latching element fixed on one part of the speed coupling and a complementary seat that is fixed on the other part of the speed coupling. When the two speed-coupling parts are fitted together the latch element fits into the seat element and latches there. To this end it is mounted on a pivotal mechanism that is actuated on movement of the insert part against the socket part. The pivotal mechanism rotates the latch element on each movement of the insert part against the socket part either into a latched position holding the coupling parts together or into an unlatched position in which the coupling parts are released from each other.

In the preferred embodiment according to FIGS. 3 through 7 the latch element is mounted outside on one side of the mixing tube 9. It is formed of a latch pin 33 that is fixed to extend perpendicular through an end of a shaft 34 that is mounted on a lateral projection 32 so it can turn about an axis parallel to the longitudinal axis of the mixing tube 9. The shaft 34 rotatably carries a cam 35 that pivots with the pin 33 fixed to it through 90° on each axial movement of the shaft 34. The correspond socket element of the latch mechanism is mounted on the housing 24 of the socket part of the speed coupling. It is formed of a socket sleeve 36 fixed to the housing and in which the latch pin 33 fits when the coupling parts are moved together. The socket sleeve 36 has a latch in which the end of the shaft 34 with the latch pin fits like a key. On movement into the socket sleeve 36 the rotary cam 35 is held on the edge of the socket sleeve 36. On moving into the socket sleeve 36 the cam is held on the edge of the socket sleeve 36. Further axial shifting of the cam 35 rotates the shaft 34 with the latch pin through 90° so that the latch pin 33 moves into its latched position as shown in FIG. 1. It is held in this position by the force of the compression spring 27.

The speed coupling can be released by pressing against the front side of the radiator housing 1. This moves the insert part with the gas nozzle 11 against the force of the spring 27 again into the housing 24. The rotary cam 35 is rotated with the latch pin 33 through 90° into its unlatched position in the lock of the socket sleeve 36. The insert part of the speed coupling can be pulled out so as to free the mixing tube 9 with the radiator housing 1 fixed to it.

According to a further embodiment not shown in the drawing the speed coupling is inside a two-part mixing tube, the nonremovable part of the speed coupling including the gas nozzle. This part with the gas nozzle thus remains on the frame after freeing of the radiator so the nozzle is freely accessible for servicing.

With the two last-described embodiments the gas nozzle preferably is bolted into a coupling part of the speed coupling. It is thus accessible after opening of the speed coupling and can be simply screwed out.

What is claimed is:

1. An infrared dryer comprising:

a frame;

a elongated mixing tube having a rear end mounted on the frame and an opposite front end;

a radiator housing having a rear side mounted on the mixing-tube front end and a front side;

a burner plate inside the housing subdividing the housing into a rear distributing compartment at the rear side and into which the tube opens and a front combustion compartment;

supply means for feeding a gas/air mixture longitudinally through the tube to the rear compartment for burning of the mixture in the front compartment and emission of infrared radiation from the front side; and fastening means between the mixing tube and the radiator housing at the front end of the mixing tube securing the radiator housing on the frame and operable from the front side for releasing the radiator housing from the frame, the fastening means including a screw engaged through the rear side and having a head accessible from the front side, the burner plate being formed with a bore through which the screw head is accessible.

2. The infrared dryer defined in claim 1 wherein the screw head is wholly in the rear distributing compartment.

3. The infrared dryer defined in claim 1 wherein the fastening means is at the rear end of the mixing tube, between the mixing tube and the frame.

4. The infrared dryer defined in claim 3, further comprising a gas nozzle fixed in the mixing tube.

5. The infrared dryer defined in claim 3 wherein the fastening means is a speed coupling operated by exerting on the housing a force parallel to the mixing tube.

6. The infrared dryer defined in claim 5 wherein the speed coupling includes a socket part fixed on the frame and connected to the supply means;

an insert part fixed to the rear end of the mixing tube and fitting in the socket; and releasable latch means between the parts displaceable by longitudinal displacement of the housing and mixing tube between a latched position for locking the parts together and an unlatched position for separation of the parts from each other.

7. The infrared dryer defined in claim 6, further comprising a gas nozzle fixed in the mixing tube.

8. An infrared dryer comprising:

a frame;

a elongated mixing tube having a rear end mounted on the frame and an opposite front end;

a radiator housing having a rear side mounted on the mixing-tube front end and a front side;

a burner plate inside the housing subdividing the housing into a rear distributing compartment at the rear side and into which the tube opens and a front combustion compartment;

supply means for feeding a gas/air mixture longitudinally through the tube to the rear compartment for burning of the mixture in the front compartment and emission of infrared radiation from the front side; and fastening means between the mixing tube and the frame at the rear end of the mixing tube securing the radiator housing on the frame and operable from the front side for releasing the radiator housing from the frame, the fastening means including a speed coupling having a socket part fixed on the frame and connected to the supply means, an insert part fixed to the rear end of the mixing tube and fitting in the socket, and releasable latch means between the parts displaceable by longitudinal displacement of the housing and mixing tube between a latched position for locking the parts together and an unlatched position for separation of the parts from each other, the latch means including a pivotal element carried on one of the parts and pivoted on longitudinal displacement of the housing and mixing tube between a pair of angularly offset positions and a latch seat on the other of the parts and latchingly engaging the pivotal element in only one of the positions.

9. The infrared dryer defined in claim 8 wherein the pivotal element is a transverse pin.

10. The infrared dryer defined in claim 9 wherein the latch means includes a cam for angularly pivoting the pin on longitudinal displacement of the mixing tube and housing.

11. The infrared dryer defined in claim 10 wherein the socket part includes a longitudinally displaceable seal member having an outer face engageable with the gas nozzle; and spring means urging the seal member outward.

12. The infrared dryer defined in claim 10 wherein in the latched position the gas nozzle is wholly inside the socket part.

* * * * *